US006793104B2

(12) United States Patent
Kao

(10) Patent No.: US 6,793,104 B2
(45) Date of Patent: Sep. 21, 2004

(54) CORK DEVICE FOR RESEALING A BOTTLE

(76) Inventor: I-Feng Kao, No. 200, Shi-Ho Road, West District, Tainan (TW)

( * ) Notice: Subject to any disclaimer, the term of this patent is extended or adjusted under 35 U.S.C. 154(b) by 353 days.

(21) Appl. No.: 10/015,769

(22) Filed: Dec. 17, 2001

(65) Prior Publication Data

US 2003/0111493 A1 Jun. 19, 2003

(51) Int. Cl.[7] ..... B67D 3/00
(52) U.S. Cl. ..... 222/481.5; 222/484; 222/558
(58) Field of Search ..... 222/481.5, 484, 222/558, 559, 560, 561, 563

(56) References Cited

U.S. PATENT DOCUMENTS 2,701,668 A * 2/1955 Zayan ..... 222/484
2,839,227 A * 6/1958 Wilson et al. ..... 222/484
3,089,626 A * 5/1963 Kubiliunas ..... 222/484
4,487,342 A * 12/1984 Shy ..... 222/481.5
4,519,529 A * 5/1985 Seltz ..... 222/484
4,946,079 A * 8/1990 Campbell ..... 222/484
5,797,521 A * 8/1998 Sobral ..... 222/531

* cited by examiner

*Primary Examiner*—Joseph A. Kaufman
(74) *Attorney, Agent, or Firm*—Rosenberg, Klein & Lee

(57) ABSTRACT

A cork device comprises a cork member and a control member. The cork member comprises a lower end to be inserted into a mouth of a bottle and an upper end. The lower end of the cork member including a liquid passage having a lower end communicated with an interior of the bottle and an upper end. The control member is pivotally mounted to the upper end of the cork member and movable between a sealing position and an open position. The control member includes a liquid outlet passage. The upper end of the liquid passage of the cork member is blocked by the control member when the control member is in the sealing position. The upper end of the liquid passage of the cork member is communicated with atmosphere via the liquid outlet passage when the control member is in the open position.

15 Claims, 6 Drawing Sheets

CORK DEVICE FOR RESEALING A BOTTLE

BACKGROUND OF THE INVENTION

1. Field of the Invention

The present invention relates to a cork device for resealing a bottle such as a wine bottle and allowing pouring of the liquid such as wine out of the bottle without the need of removing the cork device from a mouth of the bottle.

2. Description of the Related Art

A cork is usually used to seal a bottle containing grape wine, champagne or the like. Once the bottle is opened by means of removing the cork from the bottle, the fragrance and the quality of the liquor remained in the bottle deteriorate quickly. The sane problem exists in bottles using metal caps. Thus, the liquor in the unsealed bottle could become sour. A combined cork/cap structure has been proposed to solve this problem. The combined cork/cap includes a cork portion inserted into a mouth of an unsealed bottle, and a cap portion that can be turned to cause radial expansion/shrinkage of the cork portion. The cork portion can be expanded to provide the sealing function or shrunk to allow removal of the cork portion from the mouth of the unsealed bottle. Thus, the liquor in the unsealed bottle can be preserved for a longer time. However, the user has to turn the cap portion, remove the combined cork/cap, reinsert the cap portion into the bottle, and turn the cap portion in a reverse direction every time he wants to drink. This is quite inconvenient to the user.

SUMMARY OF THE INVENTION

An object of the present invention is to provide a cork device for resealing a bottle such as a wine bottle and allowing pouring of the liquid such as wine out of the bottle without the need of removing the cork device from a mouth of the bottle.

A cork device comprises a cork member and a control member. The cork member comprises a lower end to be inserted into a mouth of a bottle and an upper end. The lower end of the cork member including a liquid passage having a lower end communicated with an interior of the bottle and an upper end. The control member is pivotally mounted to the upper end of the cork member and movable between a sealing position and an open position. The control member includes a liquid outlet passage. The upper end of the liquid passage of the cork member is blocked by the control member when the control member is in the sealing position. The upper end of the liquid passage of the cork member is communicated with atmosphere via the liquid outlet passage when the control member is in the open position.

Other objects, advantages, and novel features of the invention will become more apparent from the following detailed description when taken in conjunction with the accompanying drawings.

DETAILED DESCRIPTION OF THE PREFERRED EMBODIMENT

Figure 3:
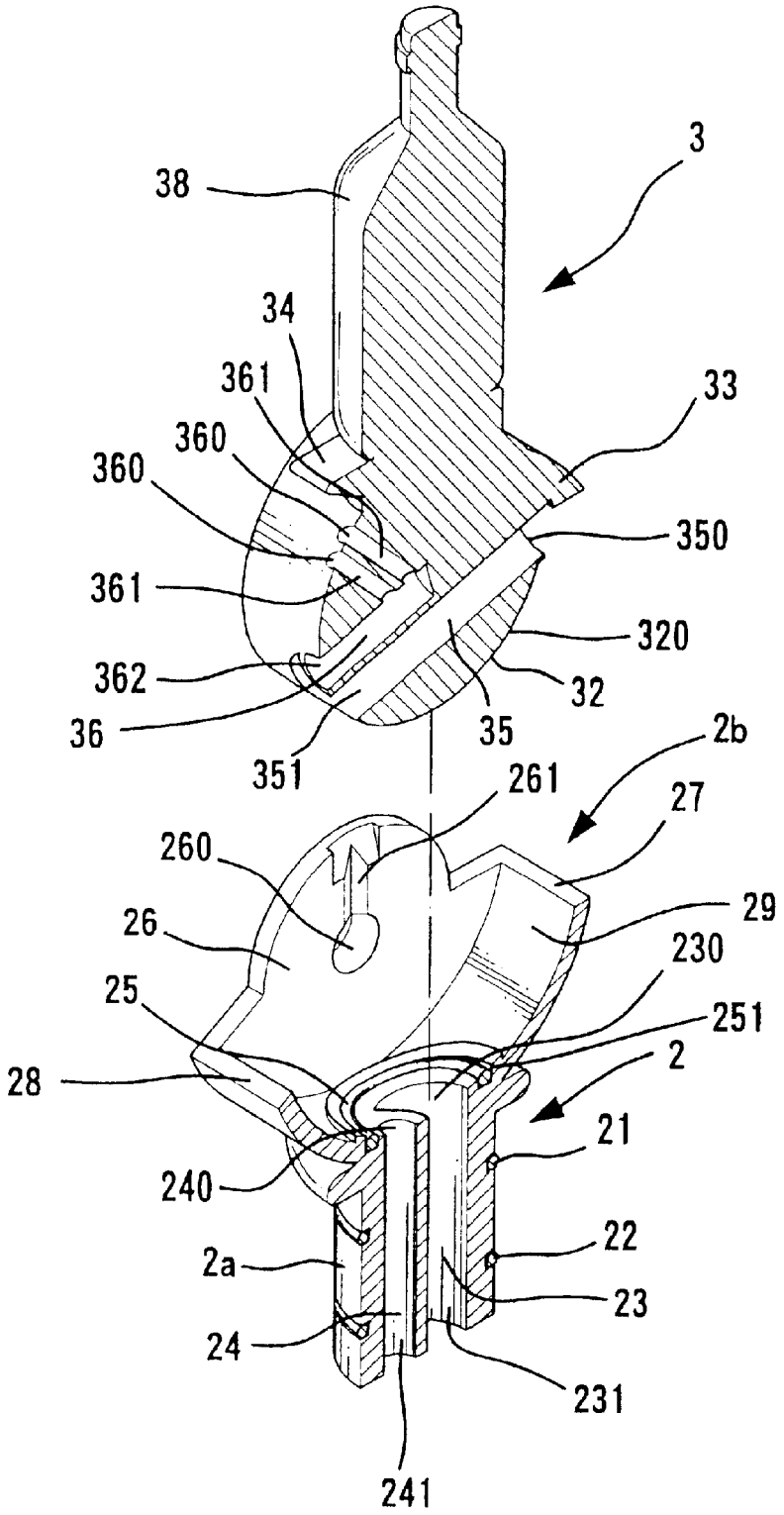
FIG. 3 is an exploded perspective view, partly cutaway, of the cork device in accordance with the present invention.
Figure 4:
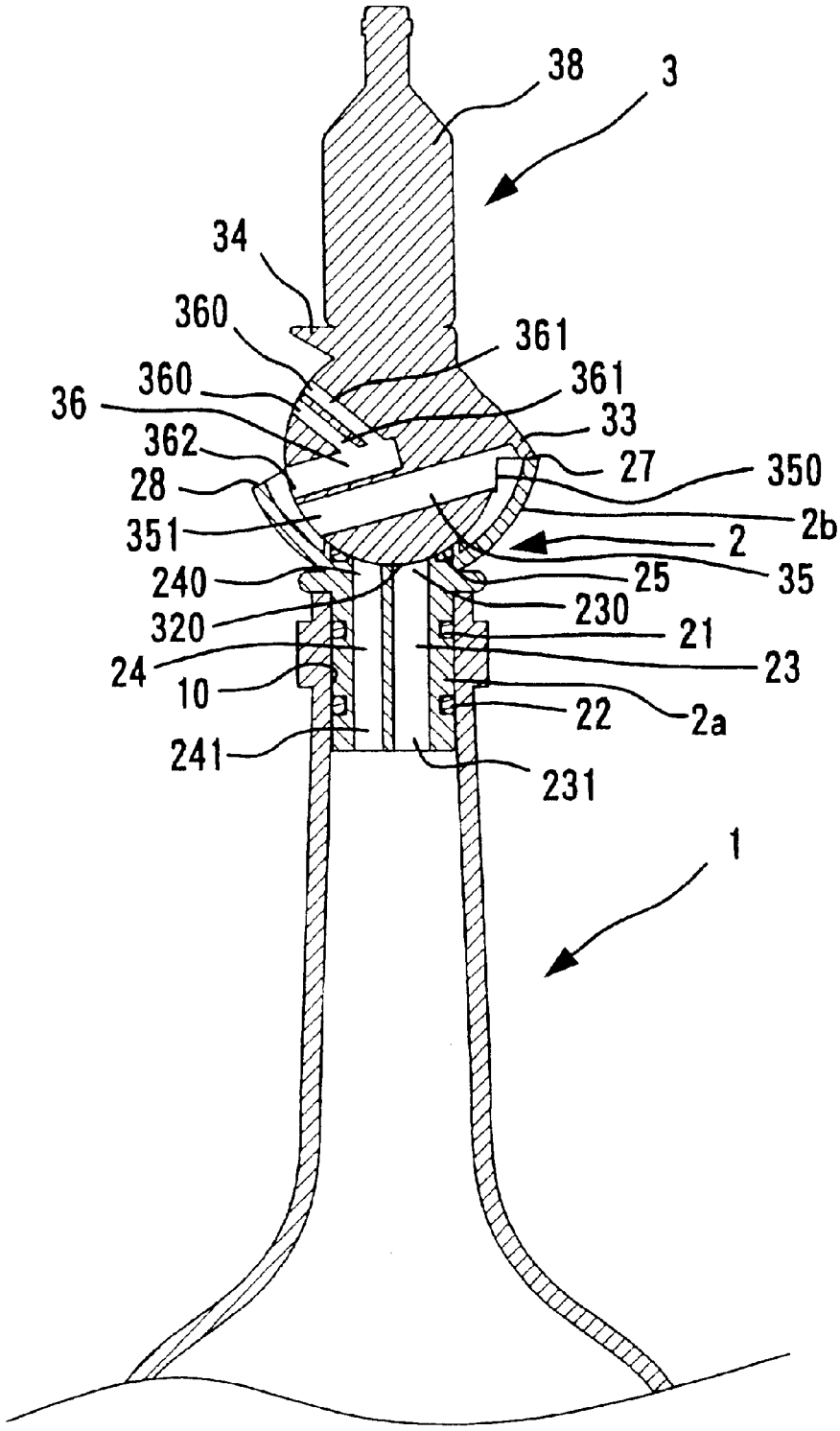
FIG. 4 is a sectional view of the cork device in a sealing position.

Referring to FIGS. 1 through 4, a cork device in accordance with the present invention generally comprises a cork member 2 and a control member 3. The cork member 2 comprises a lower end 2*a* to be inserted into a mouth 10 (FIG. 4) of a bottle 1 and an upper end 2*b* to which a lower end 32 of the control member 3 is pivotally mounted. Two O-rings 21 and 22 are received in two annular grooves (not labeled) defined in an outer periphery of the lower end 2*a* of the cork member 2 to prevent leakage of liquid in the bottle 1 when the lower end 2*a* of the cork member 2 is mounted in the mouth 10 of the bottle 1, best shown in FIG. 4. Referring to FIGS. 3 and 4, the lower end 2*a* of the cork member 2 includes a longitudinal liquid passage 23 and a longitudinal air passage 24 spaced from the longitudinal liquid passage 23. Each of the longitudinal liquid passage 23 and the longitudinal air passage 24 has a lower end 231, 241 communicated with an interior of the bottle 1 and an upper end 230, 240 facing the lower end 32 of the control member 3.

Figure 1:
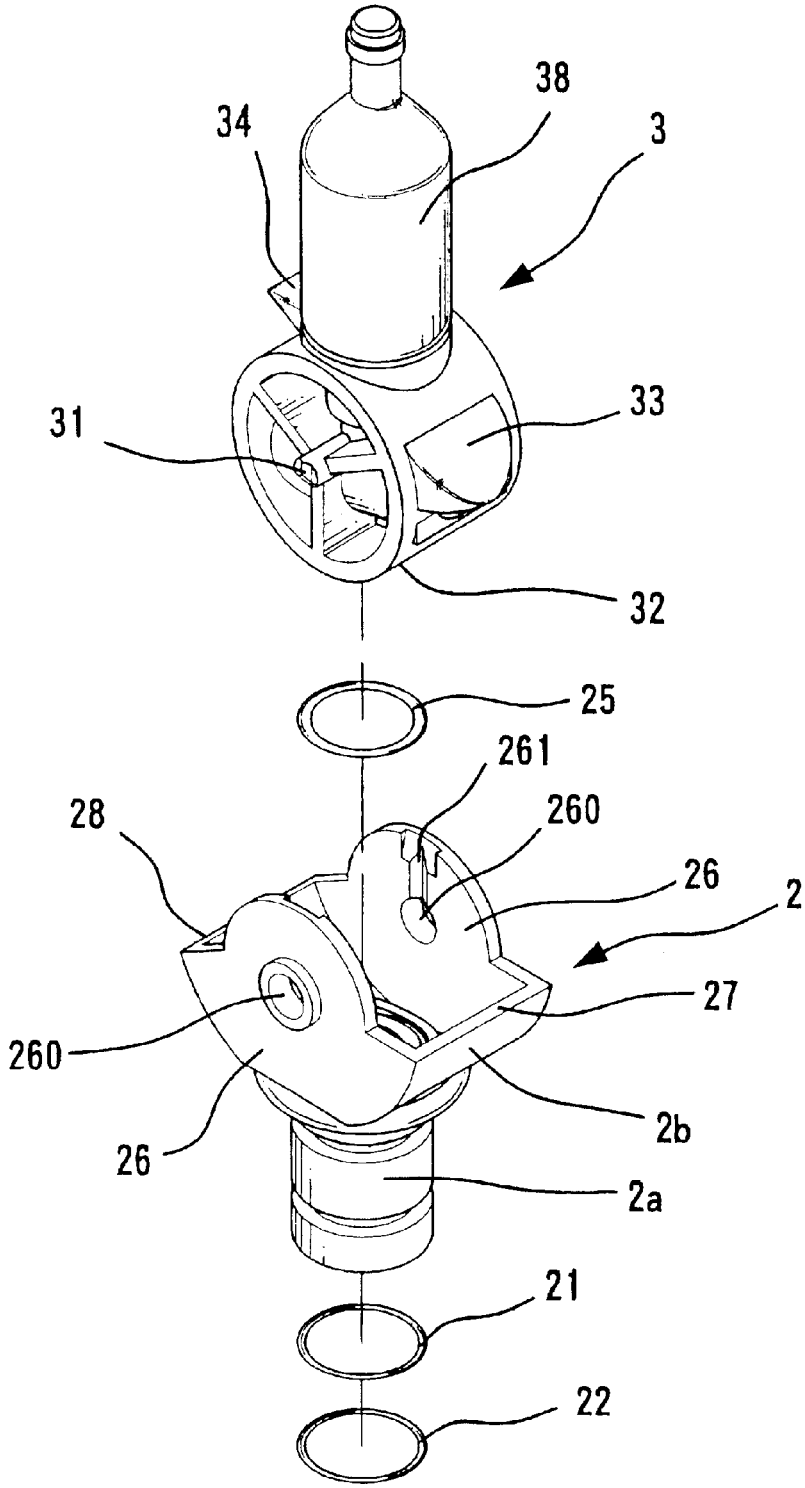
FIG. 1 is an exploded perspective view of a cork device in accordance with the present invention.
Figure 2:
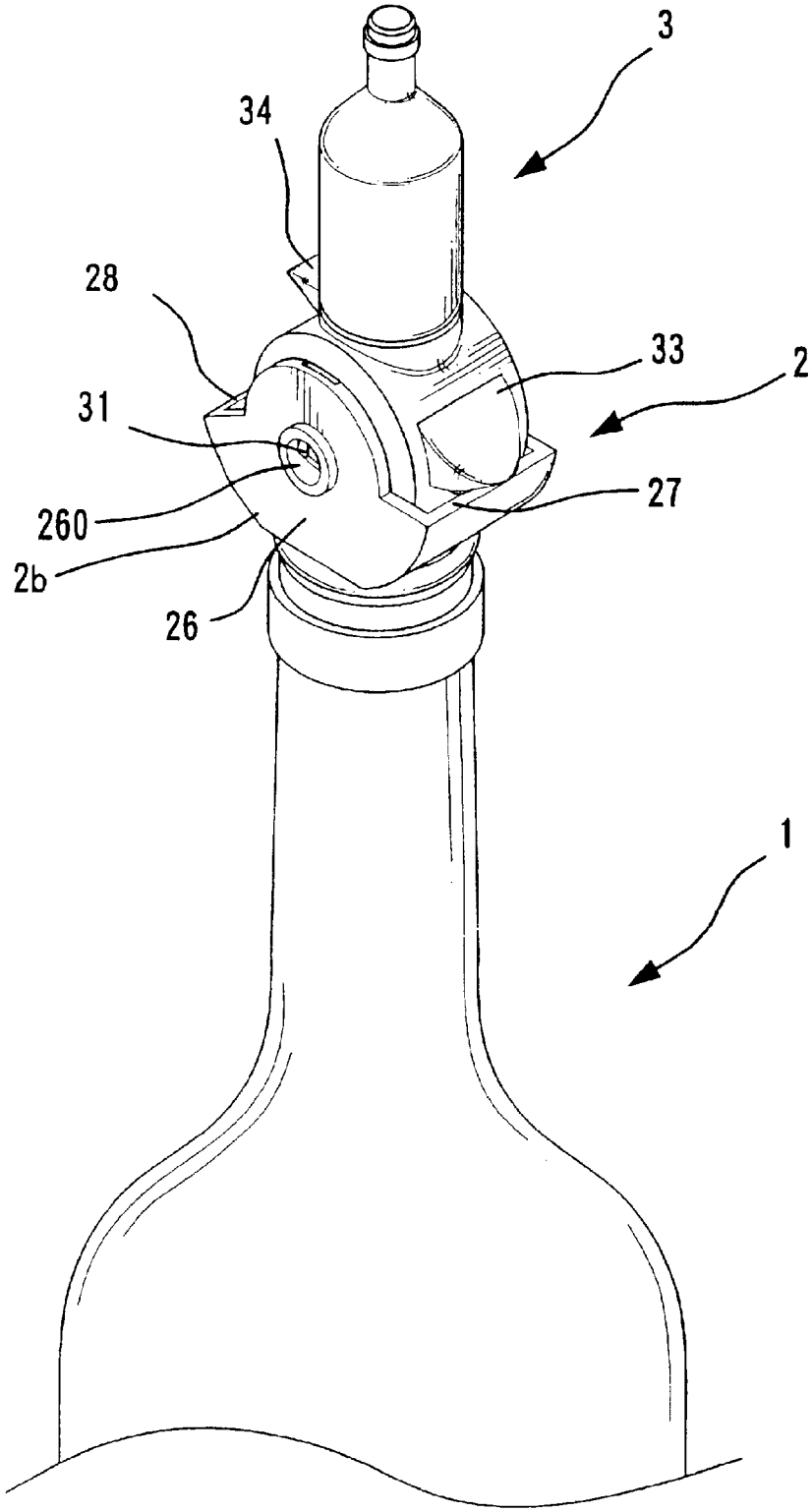
FIG. 2 is a perspective view illustrating use of the cork device in accordance with the present invention.

Referring to FIGS. 1 and 3, the upper end 2*b* of the cork member 2 comprises two opposed sidewalls 26 having aligned pivotal holes 260 and a connecting bottom wall 29, thereby defining a space for pivotally receiving the lower end 32 of the control member 3. The upper end 230 of the longitudinal liquid passage 23 and the upper end 240 of the longitudinal air passage 24 are defined in the connecting bottom wall 29. In this embodiment, the connecting bottom wall 29 is arcuate and includes a positioning groove 251 surrounding the upper ends 230 and 240 of the longitudinal liquid passage 23 and the longitudinal air passage 24, and a sealing ring 25 is mounted in the positioning groove 251 to prevent leakage of the liquid from the interior of the bottle 1.

The control member 3 includes the lower end 32 and an upper operative end 38 for manual pivotal operation. The lower end 32 of the control member 3 includes two pivotal members 31 (FIG. 1) respectively on two opposed sides thereof. The pivotal members 31 are pivotally received in the pivotal holes 260 of the upper end 2*b* of the cork member 2. Preferably, each sidewall 26 of the upper end 2*b* of the cork member 2 includes a vertical guide groove 261 (FIG. 3) for guiding the respective pivotal member 31 into the respective pivotal hole 260. Preferably, the lower end 32 of the control member 3 includes an arcuate bottom face 320 (FIG. 3) for blocking the upper end 230 of the longitudinal liquid passage 23 and the upper end 240 of the longitudinal air passage 24, best shown in FIG. 4.

The control member 3 comprises a liquid outlet passage 35 and an air inlet passage 36. In this embodiment, the liquid outlet passage 35 and the air inlet passage 36 are defined in the lower end 32 of the control member 3. The liquid outlet passage 35 includes a first end 351 and a second end 350. The air inlet passage 36 includes a first end 362 and a second end branching into two branches 361 each having an air inlet 360. The diameter of each air inlet 360 is smaller than that of the second end 350 of the liquid outlet passage 35. The control member 3 further comprises a first stop 33 on a side thereof and a second stop 34 on a second side thereof opposite to the first stop 33.

Figure 5:
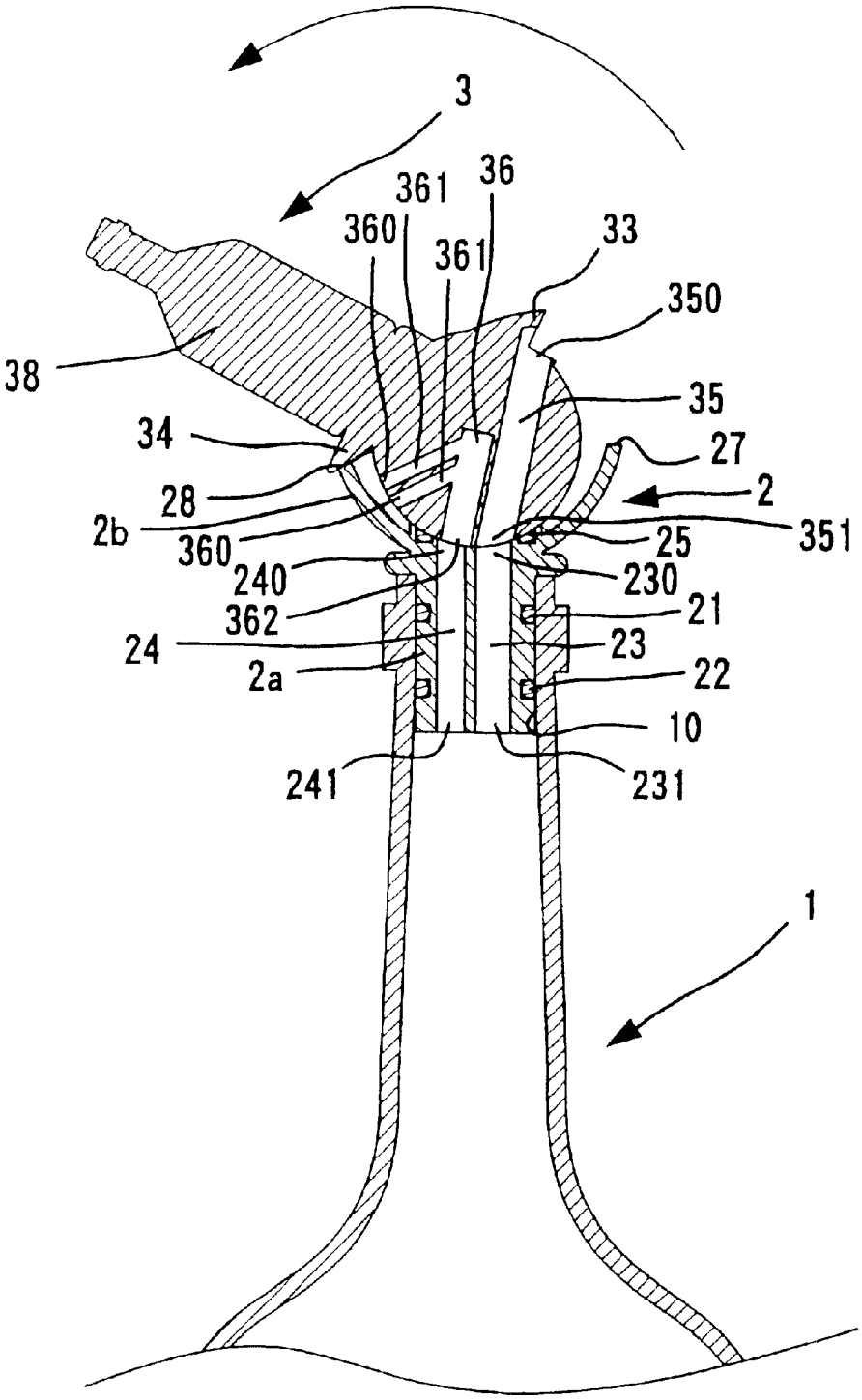
FIG. 5 is a sectional view similar to FIG. 4, wherein the cork device is in an open position.

The control member 3 is pivotable between a sealing position (FIG. 4) and an open position (FIG. 5). When the control member 3 is in the sealing position shown in FIG. 4, the upper end 230 of the longitudinal liquid passage 23 and the upper end 240 of the longitudinal air passage 24 are blocked by the arcuate bottom face 320 of the control member 3. Pouring and/or leakage of the liquid in the bottle 1 are not possible. It is noted that the first stop 33 of the control member 3 abuts against an end edge 27 of the connecting bottom wall 29 of the cork member 2. Namely, the user may pivot the control member 3 until the first stop 33 of the control member 3 abuts against the end edge 27 of the connecting bottom wall 29 of the cork member 2 when it is desired to seal the bottle 1.

When the control member 3 is pivoted to the open position shown in FIG. 5, the first end 351 of the liquid outlet passage 35 is communicated with the upper end 230 of the longitudinal liquid passage 23, and the second end 350 of the liquid outlet passage 35 is communicated with atmosphere. In addition, the first end 362 of the air inlet passage 36 is communicated with the upper end 240 of the longitudinal air passage 24, and the air inlets 360 of the air inlet passage 36 are communicated with atmosphere. It is noted that the second stop 34 of the control member 3 abuts against another end edge 28 of the connecting bottom wall 29 of the cork member 2. Namely, the user may pivot the control member 3 until the second stop 34 of the control member 3 abuts against the end edge 28 of the connecting bottom wall 29 of the cork member 2 when it is desired to pour the liquid out of the bottle 1.

Figure 6:
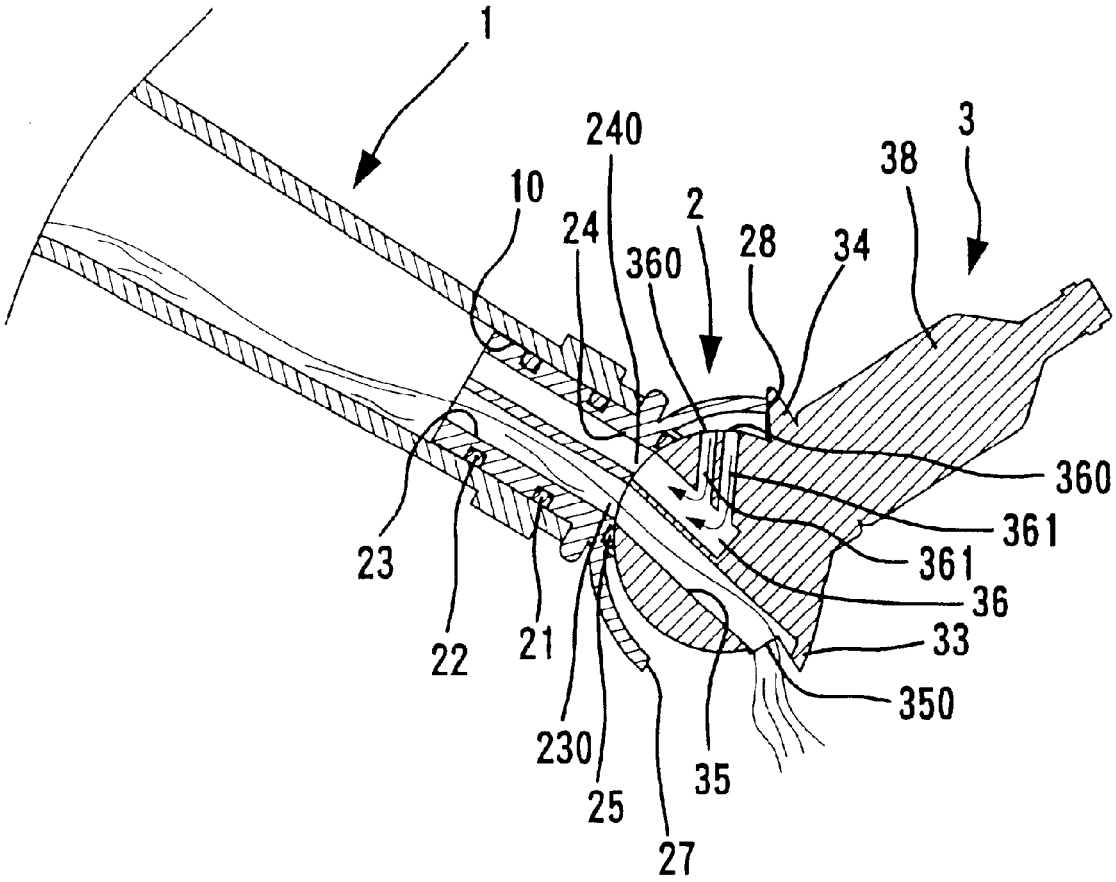
FIG. 6 is a sectional view similar to FIG. 5, illustrating pouring of liquid out of the bottle.

The liquid in the bottle 1 can be poured via the longitudinal liquid passage 23 and the liquid outlet passage 35 when the bottle 1 is moved to a position shown in FIG. 6. Atmospheric air enters the interior of the bottle 1 via the inlets 360 of the air inlet passage 36 and the longitudinal air passage 24 to compensate pressure in the bottle 1. Thus, pouring of the liquid out of the bottle 1 can continue. After pouring, the control member 3 can be pivoted back to the sealing position shown in FIG. 4 for preserving the liquid remained in the bottle 1.

It is readily apparent that the air passage 24 in the cork member 2 and the air inlet passage 36 in the control member 3 can be omitted if the diameters of the liquid passage 23 and the liquid outlet passage 35 are large enough for pouring liquid out of the bottle 1. Although the invention has been explained in relation to its preferred embodiment, it is to be understood that many other possible modifications and variations can be made without departing from the scope of the invention as hereinafter claimed.

What is claimed is:

1. A cork device comprising:

a cork member (2) comprising a lower end (2*a*) to be inserted into a mouth (10) of a bottle (1) and an upper end (2*b*), the lower end (2*a*) of the cork member including a liquid passage (23), the liquid passage having a lower end (231) communicated with an interior of the bottle (1) and an upper end (230); and a control member (3) pivotally mounted to the upper end (2*b*) of the cork member (2) and movable between a sealing position and an open position, the control member (3) including a liquid outlet passage (35);

wherein the upper end (230) of the liquid passage (23) of the cork member (2) is blocked by the control member (3) when the control member (3) is in the sealing position; and wherein the upper end (230) of the liquid passage (23) of the cork member (2) is communicated with atmosphere via the liquid outlet passage (35) when the control member (3) is in the open position;

wherein the lower end (2*a*) of the cork member (2) further comprises an air passage (24) spaced from the liquid passage (23), the air passage (24) including a lower end (241) communicated with the interior of the bottle (1) and an upper end (240);

wherein the upper end (240) of the air passage (24) of the cork member (2) is blocked by the control member (3) when the control member (3) is in the sealing position;

wherein the upper end (240) of the air passage (24) of the cork member (2) is communicated with atmosphere when the control member (3) is in the open position;

wherein the control member (3) further comprises an air inlet passage (36) for communicating the upper end (240) of the air passage (24) of the cork member (2) with atmosphere when the control member (3) is in the open position; and wherein the air inlet passage (36) of the control member (3) includes a first end (362) selectively communicated with the upper end (240) of the air passage (24) of the cork member (2) and a second end branching into two branches each having an air inlet (360) communicated with atmosphere.

2. The cork device as claimed in claim 1, wherein each said air inlet (360) of the control member (3) has a diameter smaller than that of the second end (350) of the air outlet passage (35) of the control member (3).

3. The cork device as claimed in claim 1, wherein the upper end (2*b*) of the cork member (2) comprises two opposed sidewalls (26) having aligned pivotal holes (260), the control member (3) including two pivotal members (31) respectively on two opposed sides thereof, each said pivotal member (31) being pivotally received in an associated one of the pivotal holes (260) of the cork member (2).

4. The cork device as claimed in claim 3, wherein each said sidewall (26) includes a guide groove (261) for guiding an associated one of the pivotal members (31) into an associated one of the pivotal holes (260).

5. The cork device as claimed in claim 3, wherein the upper end (2*b*) of the cork member (2) further includes a connecting bottom wall (29) connected between the sidewalls (260), thereby defining a space for pivotally receiving a lower end of the control member (3), the upper end (230) of the liquid passage (23) being defined in the connecting bottom wall (29).

6. The cork device as claimed in claim 5, wherein the connecting bottom wall (29) is arcuate.

7. The cork device as claimed in claim 5, wherein the connecting bottom wall (29) includes a sealing ring (250) surrounding the upper end (230) of the liquid passage (23) of the cork member (2).

8. The cork device as claimed in claim 6, wherein the lower end of the control member (3) includes an arcuate bottom face (320) for sealing the upper end (230) of the liquid passage (23) of the cork member (2) when the control member is in the sealing position.

9. The cork device as claimed in claim 8, wherein the liquid passage (35) is defined in the lower end (32) of the control member (3).

10. The cork device as claimed in claim 3, wherein the control member (3) includes a stop (33), and wherein the connecting bottom wall (29) includes an end edge (27) against which the stop (33) abuts when the control member is in the sealing position.

11. The cork device as claimed in claim 3, wherein the control member (3) includes a stop (34), and wherein the connecting bottom wall (29) includes an end edge (28) against which the stop (34) abuts when the control member is in the open position.

12. The cork device as claimed in claim 11, wherein the control member (3) includes a second stop (34), and wherein the connecting bottom wall (29) includes a second end edge (28) against which the second stop (34) abuts when the control member is in the open position.

13. The cork device as claimed in claim 1, wherein the control member (3) includes a stop (33), and wherein the cork member (2) includes an end edge (27) against which the stop (33) abuts when the control member is in the sealing position.

14. The cork device as claimed in claim 1, wherein the control member (3) includes a stop (34), and wherein the cork member (2) includes an end edge (28) against which the stop (34) abuts when the control member is in the open position.

15. The cork device as claimed in claim 14, wherein the control member (3) includes a second stop (34), and wherein the cork member (2) includes a second end edge (28) against which the second stop (34) abuts when the control member is in the open position.

* * * * *